US007754664B2

(12) United States Patent
Qu et al.

(10) Patent No.: US 7,754,664 B2
(45) Date of Patent: Jul. 13, 2010

(54) LUBRICANTS OR LUBRICANT ADDITIVES COMPOSED OF IONIC LIQUIDS CONTAINING AMMONIUM CATIONS

(75) Inventors: Jun Qu, Knoxville, TN (US); John J. Truhan, Jr., Cookeville, TN (US); Sheng Dai, Knoxville, TN (US); Huimin Luo, Knoxville, TN (US); Peter J. Blau, Knoxville, TN (US)

(73) Assignees: UT-Battelle, LLC, Oak Ridge, TN (US); University of Tennessee Research Foundation, Knoxville, TN (US)

( * ) Notice: Subject to any disclaimer, the term of this patent is extended or adjusted under 35 U.S.C. 154(b) by 967 days.

(21) Appl. No.: 11/533,098

(22) Filed: Sep. 19, 2006

(65) Prior Publication Data

US 2008/0070817 A1 Mar. 20, 2008

(51) Int. Cl.
*C10M 135/08* (2006.01)
*C10M 133/06* (2006.01)

(52) U.S. Cl. ..... 508/547; 508/548

(58) Field of Classification Search ..... 508/547, 508/548, 565, 577

See application file for complete search history.

(56) References Cited

U.S. PATENT DOCUMENTS

| | | | | |
|---|---|---|---|---|
| 3,951,973 | A | 4/1976 | Nebzydoski | |
| 4,115,286 | A | 9/1978 | Baldwin et al. | |
| 4,950,414 | A | 8/1990 | Wildersohn et al. | |
| 5,464,549 | A | 11/1995 | Sieberth | |
| 5,942,470 | A | 8/1999 | Norman et al. | |
| 2002/0016266 | A1 * | 2/2002 | Fletschinger et al. | 508/433 |
| 2004/0033366 | A1 * | 2/2004 | Lamanna et al. | 428/421 |

* cited by examiner

*Primary Examiner*—Glenn A Caldarola
*Assistant Examiner*—Taiwo Oladapo
(74) *Attorney, Agent, or Firm*—Novak Druce + Quigg LLP; Gregory A. Nelson; Gregory M. Lefkowitz

(57) ABSTRACT

A lubricant or lubricant additive is an ionic liquid alkylammonium salt. The alkylammonium salt has the structure $R_xNH_{(4-x)}^+,[F_3C(CF_2)_y,S(O)_2]_2N^-$ where x is 1 to 3, R is independently $C_1$ to $C_{12}$ straight chain alkyl, branched chain alkyl, cycloalkyl, alkyl substituted cycloalkyl, cycloalkyl substituted alkyl, or, optionally, when x is greater than 1, two R groups comprise a cyclic structure including the nitrogen atom and 4 to 12 carbon atoms, and y is independently 0 to 11. The lubricant is effective for the lubrication of many surfaces including aluminum and ceramics surfaces.

9 Claims, 7 Drawing Sheets

(a) Mineral oil (b) $[C_8H_{17}]_3NH,Tf_2N$ (c) Mineral oil + 10% $[C_8H_{17}]_3NH,Tf_2N$ (a) AISI 52100 steel (b) Al 6061-T (a) AISI 52100 steel (b) Al 6061-T

LUBRICANTS OR LUBRICANT ADDITIVES COMPOSED OF IONIC LIQUIDS CONTAINING AMMONIUM CATIONS

STATEMENT REGARDING FEDERALLY SPONSORED RESEARCH OR DEVELOPMENT

Invention developed under contract DE-AC05-00OR22725 with the U.S. Department of Energy. The government has certain rights in the invention.

CROSS-REFERENCE TO RELATED APPLICATIONS

Not applicable.

FIELD OF THE INVENTION

The invention pertains to ionic liquid-based lubricants and ionic liquid lubricant additives.

BACKGROUND OF THE INVENTION

Room-temperature ionic liquids (ILs) have been primarily used as "green" solvents in chemical synthesis, electrochemistry, and other applications due to their ultra-low vapor pressure, non-flammability, and high thermal stability. Ionic liquids, as the name indicates, are composed solely of ions. The most commonly studied ionic liquids are those where the cation is one of the following: 1-alkyl-3-methylimidazolium, N-alkylpyridinium, tetraalkylammonium and tetraalkylphosphonium. The organic cations, which are generally relatively large compared with simple inorganic cations, account for the low melting points of the salts. Anions range from simple inorganic anions to large complex anions. The synthesis process is environmentally friendly and does not involve high pressures (usually ambient air) or high temperatures (usually 60-80° C.).

Ionic liquids have other possible features that make them attractive for tribological applications, including negligible volatility, non-flammability, high thermal stability, and better intrinsic performance. These characteristics may avoid the need to add expensive additives to facilitate lubrication, as in the case of conventional mineral-oil-based lubricants. Detergents may not be necessary because ionic liquids act as solvents, defoamers may not be necessary due to ionic liquids' ultra-low vapor pressure, anti-oxidants may not be necessary due to the high thermal stability of ionic liquids, and antiwear additives may not be necessary if ionic liquids form boundary lubricating films.

Limited studies have shown the potential for using ionic liquids as a new class of lubricants. Friction and wear reduction have been reported on metallic and ceramic surfaces lubricated by selected ionic liquids. It has been suggested that adding a few percent of ionic liquids could improve the lubricating behavior of base oils. Most literature studies have been limited to ionic liquids with imidazolium cations and $BF_4^-$ and $PF_6^-$ anions.

Ammonium salts of partial esters of phosphoric and thiophosphoric acids are commercially available as extreme pressure and antiwear additives for lubricants and are disclosed in Sieberth, U.S. Pat. No. 5,464,549 and Norman et al., U.S. Pat. No. 5,942,470. Other patents disclosing ammonium salts of other large anions for lubricants include Nebzydoski, U.S. Pat. No. 3,951,973, Baldwin et al., U.S. Pat. No. 4,115,286, and Wildersohn et al., U.S. Pat. No. 4,950,414 where the anions are trithiocyanurate, bis[(mercaptohydrocarbyl)ethylenedioxy]borates, and cyclophosphetane derivatives, respectively. However, it remains a goal to identify ionic liquids that display superior lubricating properties as the primary lubricant or as lubricant additives, particularly for use with difficult-to-lubricate metals, like aluminum, and for ceramics. Ionic lubricants with anions that permit superior thermal stability and low water solubility are also desirable for lubricants and lubricant additives.

SUMMARY OF THE INVENTION

Figure 1:
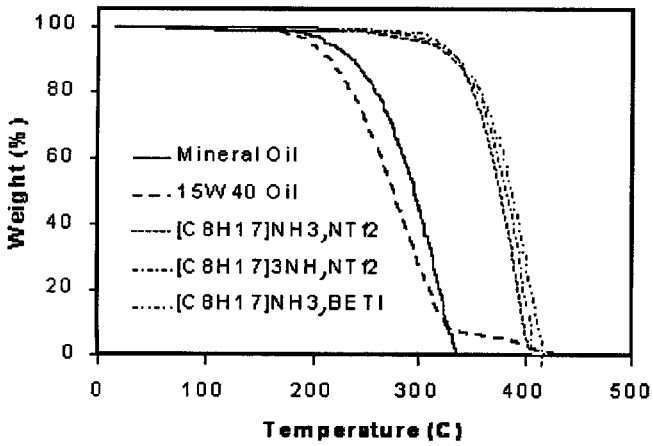
FIG. 1 is a thermal gravimetric analysis (TGA) plot of two oils and three ionic liquids.

An object of the invention is a lubricant that is an ionic liquid alkylammonium salt where the alkylamonium salt has the formula:

$R_xNH_{(4-x)}^+$,$[F_3C(CF_2)_yS(O)_2]_2N^-$ where x is 1 to 3, R is independently $C_1$ to $C_{12}$ straight chain alkyl, branched chain alkyl, cycloalkyl, alkyl substituted cycloalkyl, cycloalkyl substituted alkyl, or when x is greater than 1, two R groups comprise a cyclic structure including the nitrogen atom and 4 to 12 carbon atoms, and y is independently 0 to 11. The alkylammonium salt can have a water solubility less than 100 mM and can have an onset of thermal decomposition temperature that is greater than 330° C.

A lubricant additive mixture is a mineral or hydrocarbon oil and an ionic liquid alkylammonium salt where the alkylamonium salt has the formula $R_xNH_{(4-x)}^+$, $[F_3C(CF_2)_yS(O)_2]_2N^-$ where x is 1 to 3, R is independently $C_1$ to $C_{12}$ straight chain alkyl, branched chain alkyl, cycloalkyl, alkyl substituted cycloalkyl, cycloalkyl substituted alkyl, or when x is greater than 1, two R groups comprise a cyclic structure including the nitrogen atom and 4 to 12 carbon atoms, and y is independently 0 to 11.

A method of lubrication includes the steps of providing an ionic liquid alkylammonium salt of the formula: $R_xNH_{(4-x)}^+$, $[F_3C(CF_2)_yS(O)_2]_2N^-$ where x is 1 to 3, R is independently $C_1$ to $C_{12}$ straight chain alkyl, branched chain alkyl, cycloalkyl, alkyl substituted cycloalkyl, cycloalkyl substituted alkyl, or when x is greater than 1, two R groups comprise a cyclic structure including the nitrogen atom and 4 to 12 carbon atoms, and y is independently 0 to 11; and supplying the ammonium salt to a contact between a first surface and second surface. The first and second surfaces can be independently a metal surface or a ceramic surface. The metal surface can be an aluminum alloy or a steel alloy. The method of lubrication can also include providing a mineral oil or a hydrocarbon oil and supplying the oil to the contact between the surfaces.

DETAILED DESCRIPTION OF THE INVENTION

Ionic liquids that are easily prepared and useful as lubricants and property-enhancing additives to lubricants comprise ammonium salts of primary, secondary, and tertiary amines with a bis(perfluoroalkanesulfonyl)imide anion. These ammonium salts display good viscosities for lubricating surfaces at high and low temperatures. These salts display good thermal stability relative to mineral oil and conventional motor oils where the ionic liquid displays an onset of decomposition that is greater than about 330° C. These salts display a low affinity for water where the solubility of the ionic liquid in water is less than 100 mM. The melting points of the salts are low, generally below 25° C. The structure of these ionic liquid ammonium salts are given by the structure:

$$R_xNH_{(4-x)}^+, [F_3C(CF_2)_yS(O)_2]_2N^-$$

where x is 1 to 3, R is independently $C_1$ to $C_{12}$ straight chain alkyl, branched chain alkyl, cycloalkyl, alkyl substituted cycloalkyl, cycloalkyl substituted alkyl, or, when x is greater than 1, two R groups comprise a cyclic structure including the nitrogen atom and 4 to 12 carbon atoms, and y is independently 0 to 11. Preferred anions are $[F_3CS(O)_2]_2N^-$ and $[F_3CCF_2S(O)_2]_2N^-$, which are alternately indicated as $Tf_2N$ and BETI, respectively, in the following text, tables, and figures.

The ammonium salts can be readily prepared from the appropriate organic amine, $R_xNH_{(3-x)}$, where R and x are as defined above for the ammonium salts. The amine is mixed with an equal molar quantity of lithium bis(perfluoroalkanesulfonyl)imide, $Li^+[F_3C(CF_2)_yS(O)_2]_2N^-$ at room temperature. The addition of a small molar excess of aqueous HCl solution results in the exothermic formation of the desired ammonium salt and lithium chloride as a two layer system. The ammonium salt ionic liquid lower layer is subsequently separated from the top aqueous layer. Multiple washings with deionized water removes LiCl and excess HCl from the ammonium salt ionic liquid. The ammonium salt can be dried by heating under vacuum, for example heating to 70° C. under vacuum for 4 hours.

Properties important for lubricants include the viscosity and the change in viscosity with temperature. The viscosities and densities of representative ammonium salts of the present invention are given in Table 1 below. For comparison, the properties of mineral oil and 10W40 diesel engine oil are included in Table 1. As can be seen in Table 1, the density of the ionic liquid is greater than that of the oils, primarily due to the presence of the multiple fluorine atoms of the anion in the ionic liquids. To permit comparison to standard viscosities for motor oils, the table gives the viscosity in cp at three temperatures (23, 40, and 100° C.) and the viscosity in cst at 100° C. The viscosities of the ionic liquids at 100° C. are all below the maximum of 26.1 cst for an SAE 60 motor oil and all are below the SAE 50 maximum of about 280 cp at 40° C.

TABLE 1

Viscosities and Densities

| | Density | Viscosity (cP) | | | Visc (cst) | Ratio Visc |
|---|---|---|---|---|---|---|
| Lubricants | g/cc | 23° C. | 40° C. | 100° C. | 100° C. | 23° C./00° C. |
| Mineral Oil | 0.86 | 159 | 56 | 6.3 | 5.418 | 25.2 |
| 15W40 Oil | 0.86 | 229 | 91 | 11.3 | 9.718 | 20.3 |
| $[C_6H_{13}]_3NH,Tf_2N$ | 1.12 | 170 | 72 | 9.7 | 10.864 | 17.5 |
| $[C_8H_{17}]_3NH,Tf_2N$ | 1.06 | 219 | 89 | 11.7 | 12.402 | 18.7 |
| $[C_8H_{17}]NH_3,Tf_2N$ | 1.37 | 331 | 125 | 14.2 | 19.454 | 23.3 |
| $[C_2H_5]_3NH,BETI$ | 1.48 | 163 | 67 | 9.3 | 13.764 | 17.5 |
| $[C_8H_{17}]NH_3,BETI$ | 1.45 | 763 | 265 | Not measured | | |

The water solubility of these ionic liquids is low, as is illustrated by the measured data in Table 2 below. The solubility of the ammonium salts in water is less than 100 mM in all cases. Conversely, the solubility of water in the ionic liquid is low, where the ppm water in the wet ionic liquid is on average lower than the value equivalent to one molecule of water per equivalent of ammonium salt. The solubility of water in the ionic liquids is low in spite of the ion-dipole and hydrogen bonding interactions that are possible between ammonium salts and water. The dried ionic liquids have an average equivalency of 0.02 equivalents of water per equivalent of ammonium salt. The data suggests that the size of the anion has a more pronounced affect on the solubility of the salt in water and the solubility of water in the salt than does the number of hydrogen atoms attached to the nitrogen of the ammonium salt. Although these values are very low for wet salts, they are still about 50 times greater than those of typical lubricating oils. However the dried ionic liquids have a water content similar to wet hydrocarbon oils and this capacity to accept water can allow the ionic liquid to be used as a lubricant without the addition of a detergent additive. Alternately the ionic liquids can be used as lubricant additives in lubricant formulations where a traditional detergent additive is not required.

TABLE 2

Solubility of Ionic Liquids in Water and Water in Ionic Liquids

| Salt | Solubility mM in $H_2O$ | ppm $H_2O$ in Salt Dried | ppm $H_2O$ in Salt Wet | Equivalents $H_2O$/Salt Dried | Equivalents $H_2O$/Salt Wet |
|---|---|---|---|---|---|
| $[C_2H_5]_3NH,Tf_2N$ | 95.7 | 453 | 27,800 | 0.008 | 0.505 |
| $[C_2H_5]_3NH,BETI$ | 14.1 | 131 | 22,700 | 0.003 | 0.539 |
| $[C_8H_{17}]NH_3,Tf_2N$ | 96.0 | 2,285 | 63,100 | 0.044 | 1.295 |
| $[C_8H_{17}]NH_3,BETI$ | 17.9 | 608 | 17,300 | 0.015 | 0.436 |
| Average | | | | 0.018 | 0.694 |

A feature of these ionic liquids is their superior thermal stability. As seen in Table 3 below, and as illustrated by the thermal gravimetric trace of FIG. 1, the ionic liquids of this invention do not display onsets of thermal decomposition until temperatures are in excess of 330° C. This temperature is nearly 100° C. greater than that displayed by a typical lubricating oil. This feature can permit their use as lubricants in a hotter engine and can extend the lifetime of the lubricant due to its resistance to thermal breakdown.

TABLE 3

Temperature for Onset of Decomposition of Oils and Ionic Liquids

| Lubricant | Onset of Decomposition in ° C. |
|---|---|
| Mineral Oil | 259 |
| 15W40 Oil | 236 |
| $[C_2H_5]_3NH,Tf_2N$ | 355 |
| $[C_3H_7]_3NH,Tf_2N$ | 335 |
| $[C_4H_9]_3NH,Tf_2N$ | 335 |
| $[C_5H_{11}]_3NH,Tf_2N$ | 340 |
| $[C_6H_{13}]_3NH,Tf_2N$ | 340 |
| $[C_8H_{17}]_3NH,Tf_2N$ | 357 |
| $[C_8H_{17}]NH_3,Tf_2N$ | 350 |
| $[C_8H_{17}]NH_3,BETI$ | 354 |

Figure 2:
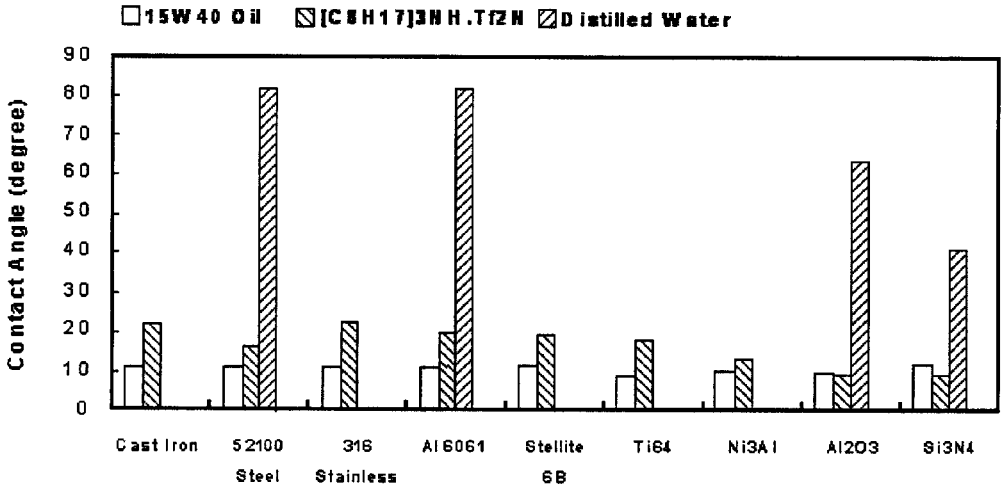
FIG. 2 is a bar graph of contact angles for an oil, water, and an ionic liquid on various substrates.

Wettability, is another important lubricant requirement, indicating how well a lubricant can cover (wet) a solid surface. The contact angles of 15W40 oil, a representative ammonium-based ionic liquid ($[C_8H_{17}]_3NH,Tf_2N$), and distilled water are shown in FIG. 2 for a variety of metallic and ceramic surfaces. All of the surfaces were metallurgy polished and carefully cleaned. The arithmetic average roughness of all the solid surfaces ranges from 0.02-0.03 μm. The ammonium salt ionic liquids wet solid surfaces well when compared to distilled water. The wettability of the ammonium salt is similar or better than 15W40 oil on ceramic surfaces, and is similar to the oil on the metallic surfaces.

The lubricating properties of the ammonium salt are very good, and particularly good for use on aluminum surfaces. Two conventional hydrocarbon oils (mineral oil and 15W40 diesel engine oil) and five ionic liquids were examined to determine whether they would effectively lubricate a steel-aluminum contact. Experiments were carried out on a high frequency reciprocating sliding tester (Plint TE-77) with a 6.35 mm diameter AISI 52100 bearing steel ball sliding against an Al 6061-T6 flat in the ambient environment under 38.3 N load, 5 Hz frequency, and 10 mm stroke.

Figure 3:
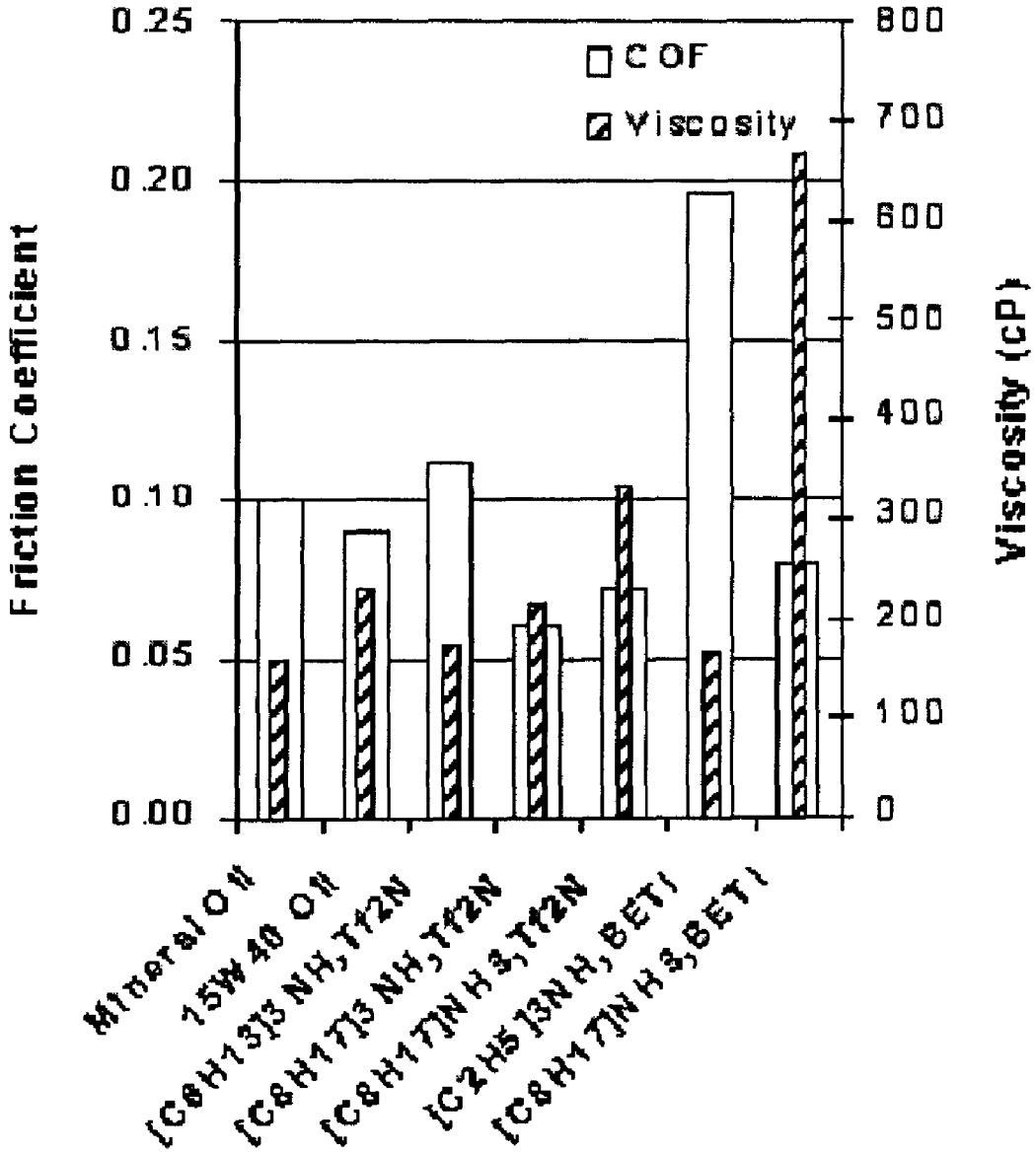
FIG. 3 is a composite bar graph of the coefficient of friction and viscosity for two oils and five ammonium salt ionic liquids.
Figure 4:
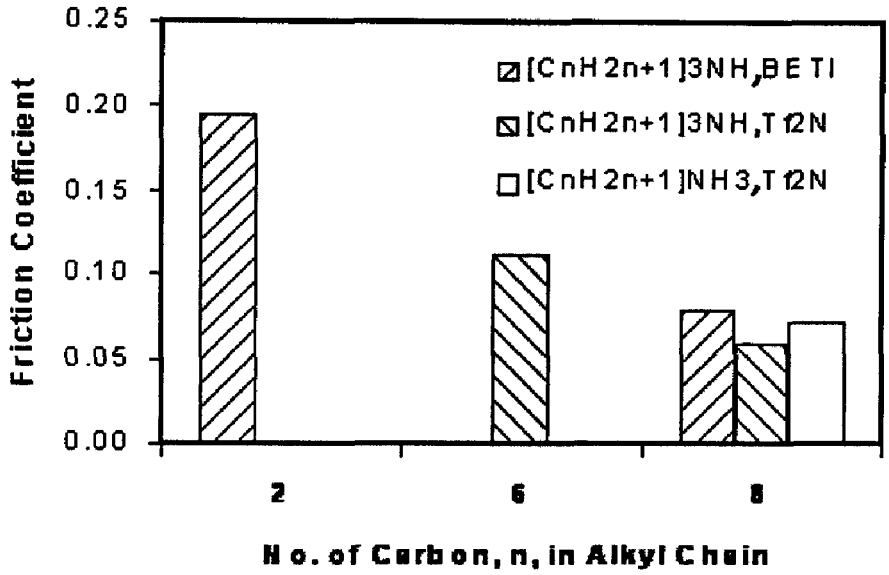
FIG. 4 is a bar graph of the coefficient of friction vs. the size of the alkyl chain of ammonium salt ionic liquids.

The measured friction coefficients of the oils and ionic liquids and their viscosities are shown in FIG. 3. Four out of five ionic liquids perform similarly or better than the oils. Particularly, $[C_8H_{17}]_3NH,Tf_2N$ has a similar viscosity ($\eta$=219 cP) but provides more than 30% friction reduction ($\mu$=0.06) compared to the fully-formulated 15W40 oil ($\eta$=229 cP, $\mu$=0.09). The ammonium cations with longer alkyl chains tend to produce lower friction coefficients, as shown in FIG. 4.

Figure 5:
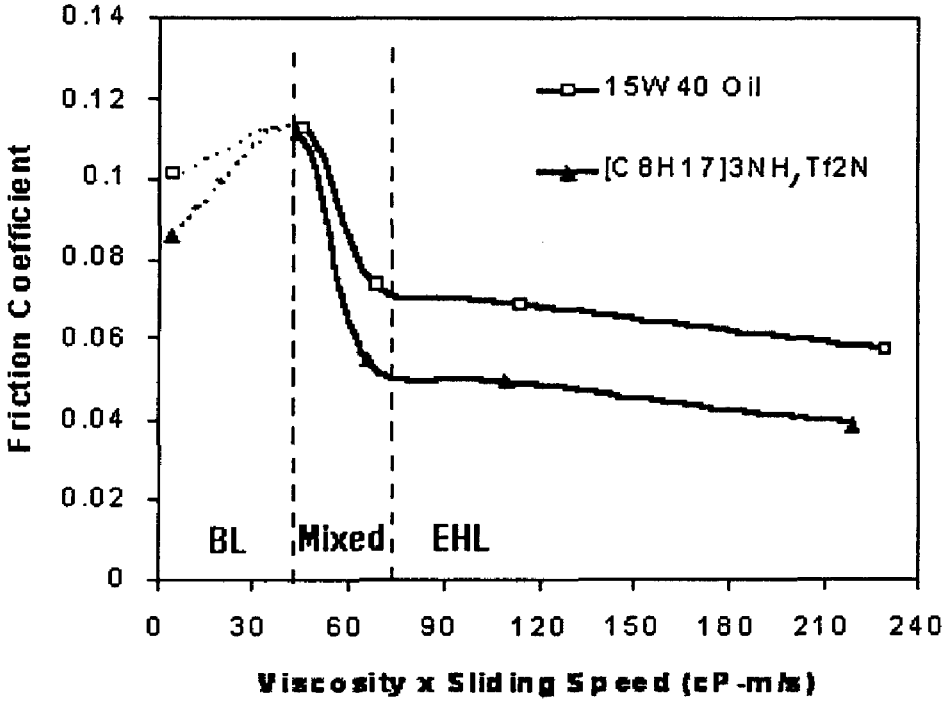
FIG. 5 is a composite Stribeck curve graph of the frictional coefficient change as a function of the product of the viscosity times the sliding speed for an oil and an ammonium salt ionic liquid.

The ionic liquid, $[C_8H_{17}]_3NH,Tf_2N$, compared favorably with fully formulated 15W40 engine oil in different lubrication regimes. Tests were conducted on a pin-on-disk unidirectional sliding configuration. A 6.35 mm diameter 52100 steel ball with a flattened tip (contact area d=2 mm) was rubbing against an Al 6061-T6 disk under a fixed load (38.3N). Stribeck curves were constructed from data collected by varying the sliding speed from high to low (1-0.2 m/s) to obtain the friction behavior at elastohydrodynamic (EHL), mixed, and boundary lubrication (BL), as shown in FIG. 5. A longer period of sliding at a very low speed (0.02 m/s) was carried out to achieve a steady-state friction coefficient at BL, which is shown as the very left data point on each curve in FIG. 5. The Stribeck curves illustrates that $[C_8H_{17}]_3NH,Tf_2N$ produced a lower friction coefficient than the 15W40 oil throughout all sliding speeds.

Wear studies on steel-aluminum contact using conventional oils and ionic lubricants were carried out on a high frequency reciprocating sliding tester (Plint TE-77) with a 6.35 mm diameter 52100 steel ball rubbed against three aluminum alloy flats (Al 1100, Al 6061-T6, and cast Al 319) under 100 N load, 10 Hz frequency, and 10 mm stroke, for 400 meters sliding distance. The friction forces were measured and wear volumes on the aluminum flats were post-test quantified by wear scar profilometry.

Figure 6:
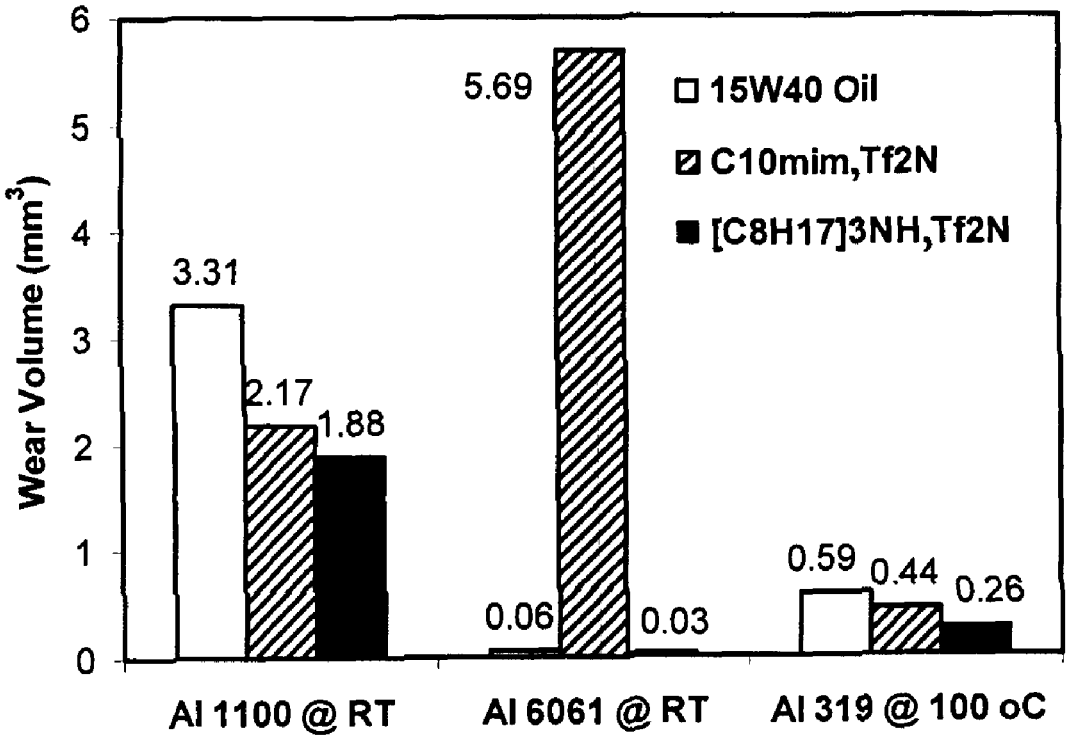
FIG. 6 is a bar graph of the wear reduction on three aluminum alloys using 1-decyl-3-methylimidazolium,$[F_3CS(O)_2]_2N^-$ (C10 min, $Tf_2N$), $[C_8H_{17}]_3NH^+$,$[F_3CS(O)_2]_2N^-$ ($[C_8H_{17}]_3NH$,$Tf_2N$), and a 15W40 engine oil.

The wear volumes on the three aluminum flats are given in FIG. 6 for 15W40 oil, a prior art 1-decyl-3-methylimidazolium,$Tf_2N$, and $[C_8H_{17}]_3NH.Tf_2N,Tf_2N$. As shown in FIG. 6, the ammonium salt ionic liquid, $[C_8H_{17}]_3NH,Tf_2N$, performed much better than the prior art 1-decyl-3-methylimidazolium,$Tf_2N$ even though they contained the same anion, with the ammonium salt of the present invention performing more than 100 times better with respect to wear volume with the Al 6061 alloy than does the prior art 1-alkyl-3-methylimidazolium salt. This wear volume difference clearly illustrates that the lubricant properties result from the combination of the cation and anion present in the ionic liquid rather than from only the anion.

Figure 7:
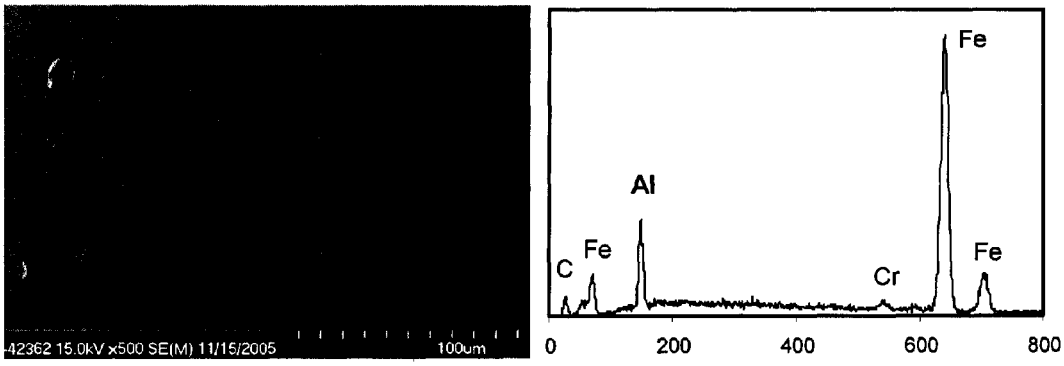
FIG. 7 is a composite of SEM images and EDS spectrums of the wear scars on steel balls in (a) mineral oil, (b) an ionic liquid, and (c) a 90 vol % mineral oil 10 vol % ionic liquid blend.
Figure 7:
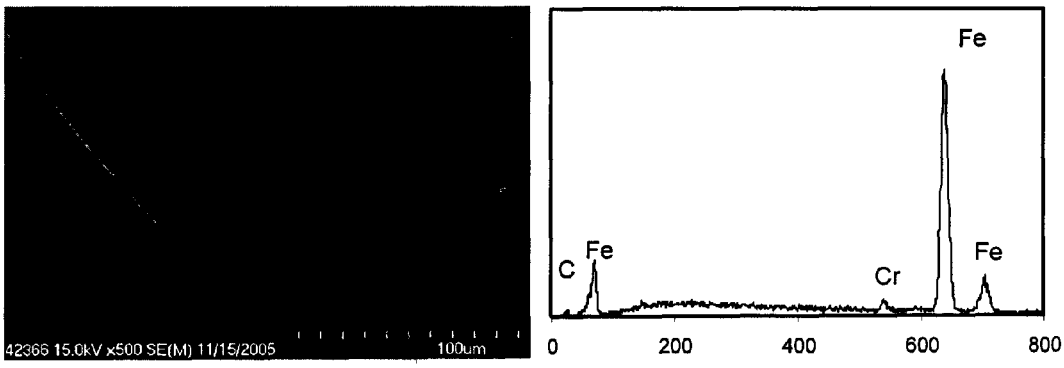
Figure 7:
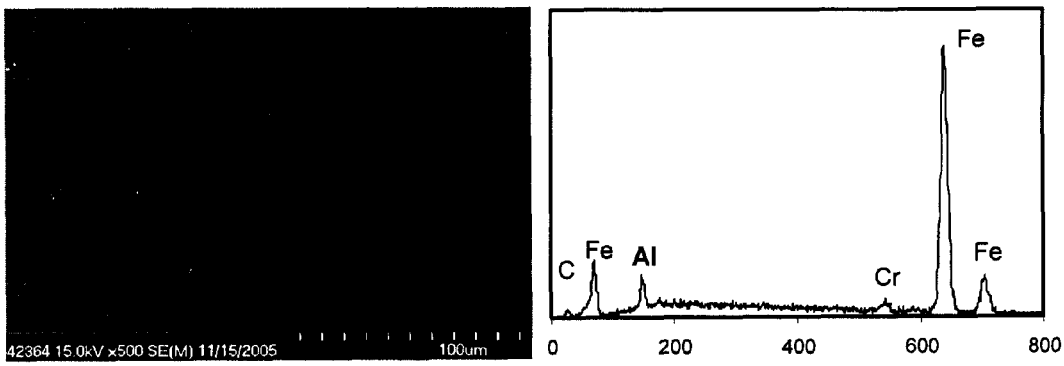

The ammonium salt ionic liquid, $[C_8H_{17}]_3NH,Tf_2N$, produces significantly less wear compared to the fully formulated 15W40 engine oil for aluminum-steel contact. FIG. 6 shows a reduction in wear volume of 43-56% for two aluminum alloys, 1100 and 6061, at room temperature and aluminum alloy 319 at 100° C. relative to the wear volume using oil. The wear amount on the steel ball was negligible, but the contact area exhibited scratches and some deformation. When an oil was used, material transferred to the steel ball. As shown in FIG. 7(*a*), the ball wear scar generated in mineral oil displayed scratches along the sliding direction in the scar center, indicating abrasive wear, and displayed surrounding adhered material, indicating adhesive wear. The aluminum peak in the energy dispersive spectroscopy (EDS) spectrum (FIG. 7(*a*)) indicated that material was transferred from the aluminum flat to the steel ball. Similar surface damage was also observed on the steel ball lubricated by 15W40 oil. However, when the lubricant was $[C_8H_{17}]_3NH,Tf_2N$, the worn surface of the ball had no apparent material transfer or adhesion, as shown in FIG. 7(*b*). The EDS spectrum displayed no Al peak, indicating no counterface material transfer when the ionic liquid was used as the lubricant. The lack of adhesive wear on the steel-aluminum contact lubricated by the ionic liquid is unexpected because aluminum alloys are well known to transfer to the counterface and cause adhesive wear when rubbing against most metals.

Figure 8:
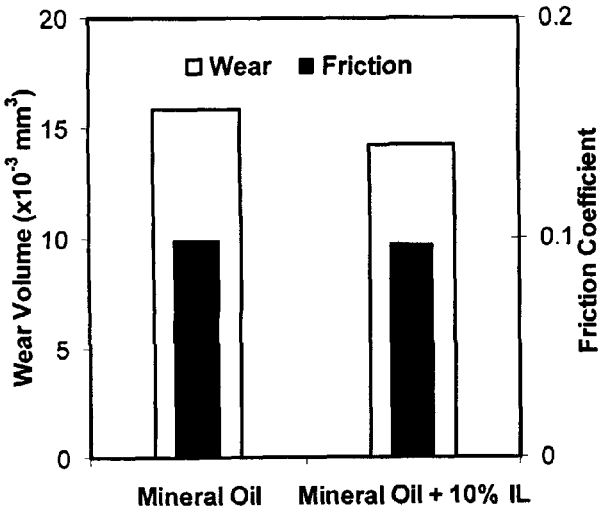
FIG. 8 is a graph of the friction coefficient for mineral oil and a blend of 90 vol % mineral oil and 10 vol % ionic liquid.

A mixture of 90 vol % mineral oil and 10 vol % $[C_8H_{17}]_3NH,Tf_2N$ produces some wear reduction relative to that of 100 vol % mineral oil when used to lubricate steel-aluminum contact, as shown in FIG. 8. This result illustrates the ability to use the ionic liquids of the invention as anti-wear additives for the improvement of multiple lubricant properties. The SEM image and EDS spectrum of the ball wear scar for the mixture of 90 vol % mineral oil and 10 vol % $[C_8H_{17}]_3NH,Tf_2N$ are shown in FIG. 7(C). The amount of aluminum transferred to the ball surface was significantly reduced relative to that for 100 vol % mineral oil, as shown in FIG. 7(*a*).

Figure 9:
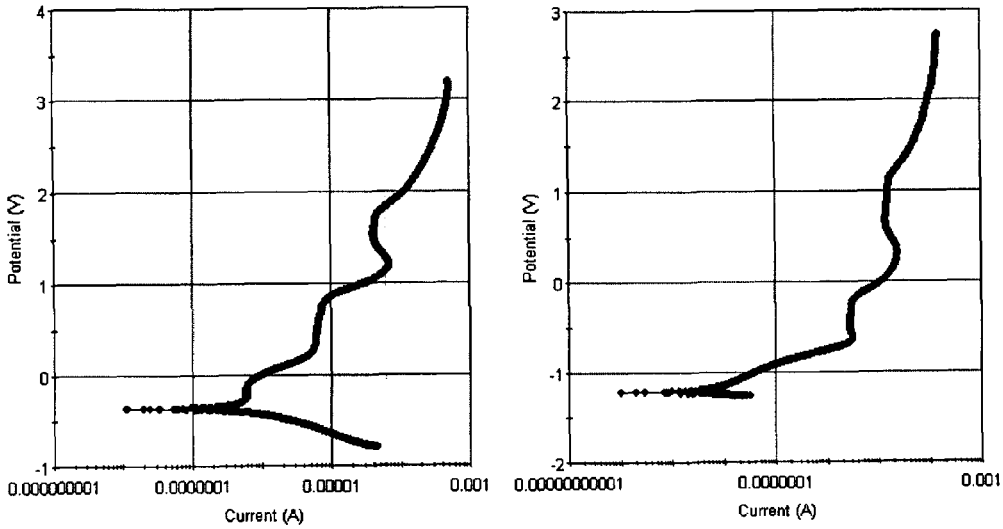
FIG. 9 is a pair of potentiodynamic polarization curves of steel and aluminum in an ionic liquid.

Although ionic liquids, have a potential to react with metal surfaces, little corrosivity information is available on ionic liquids. Electrochemical measurements have been carried out to investigate the corrosivity of $[C_8H_{17}]_3NH,Tf_2N$ on steel and aluminum alloys. FIG. 9 shows the potentiodynamic polarization curves of 52100 steel and Al 6061-T6 in $[C_8H_{17}]_3NH,Tf_2N$. Both curves show active-passive corrosion behavior for these metals with the ionic liquid. Both curves display an active dissolution behavior from $E_{corr}$ to a certain voltage followed by a region of weak passivation and a transpassive region, beyond which a second and even a third passive-transpassive cycle appears.

Figure 10:
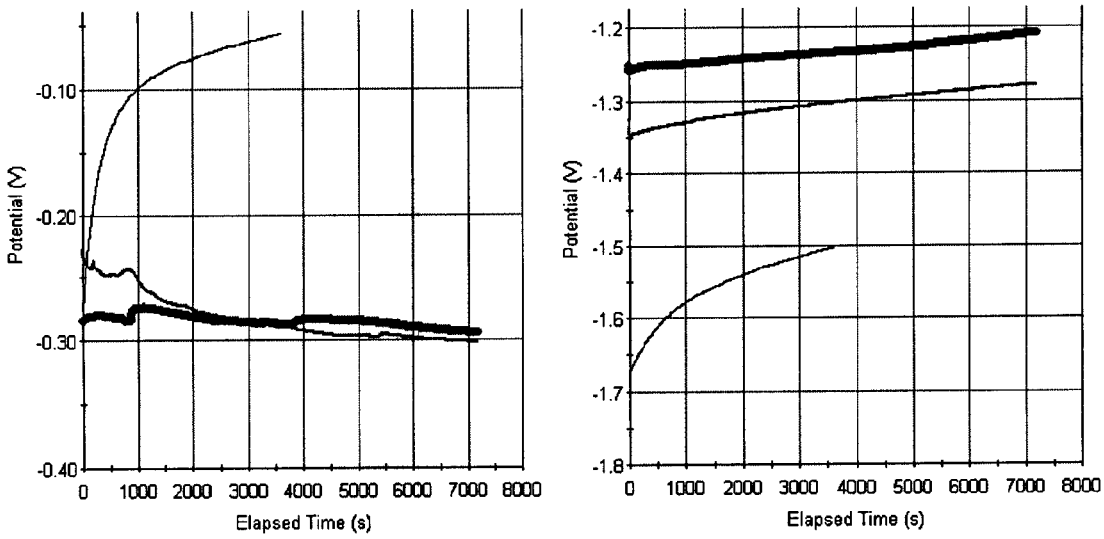
FIG. 10 is a pair of open-circuit curves of steel and aluminum in an ionic liquid.

The open circuit measurements indicated that the steel and aluminum alloys stabilize relatively quickly in $[C_8H_{17}]_3NH,Tf_2N$ as shown in FIG. 10. The $[C_8H_{17}]_3NH,Tf_2N$ ionic liquid can quickly react with the fresh surface revealed by material removal and deformation from sliding forming a boundary film, which eliminates adhesion problems and leads to the displayed low friction coefficient.

It is to be understood that while the invention has been described in conjunction with the preferred specific embodiments thereof, that the foregoing description as well as the examples are intended to illustrate and not limit the scope of the invention. Other aspects, advantages and modifications within the scope of the invention will be apparent to those skilled in the art to which the invention pertains.

We claim:

1. A lubricant comprising:

an ionic liquid alkylammonium salt of the formula:

$$R_xNH_{(4-x)}^{+},\ [F_3C(CF_2)_yS(O)_2]_2N^-$$

where x is 1 to 3, R is independently $C_3H_7$, $C_4H_9$, $C_5H_{11}$, $C_6H_{13}$, $C_8C_{17}$, branched chain alkyl, cycloalkyl, alkyl substituted cycloalkyl, cycloalkyl substituted alkyl, or, when x is greater than 1, two R groups comprise a cyclic structure including the nitrogen atom and 4 to 12 carbon atoms, and y is independently 0 to 11.

2. The lubricant of claim 1, wherein said alkylammonium salt is $[C_8H_{17}]_3NH^+,[F_3CS(O)_2]_2N^-$.

3. The lubricant of claim 1, wherein said alkylammonium salt has a water solubility less than 100 mM.

4. The lubricant of claim 1, wherein said alkylammonium salt has an onset of thermal decomposition temperature greater than 330° C.

5. A lubricant additive mixture comprising:

an ionic liquid alkylammonium salt of the formula:

$$R_xNH_{(4-x)}^{30},[F_3C(CF_2)_yS(O)_2]_2N^-$$

where x is 1 to 3, R is independently $C_3H_7$, $C_4H_9$, $C_5H_{11}$, $C_6H_{13}$, $C_8H_{17}$, branched chain alkyl, cycloalkyl, alkyl substituted cycloalkyl, cycloalkyl substituted alkyl, or when x is greater than 1, two R groups comprise a cyclic structure including the nitrogen atom and 4 to 12 carbon atoms, and y is independently 0 to 11; and a mineral or hydrocarbon oil.

6. A method of lubricating comprising the steps of:

providing an ionic liquid ammonium salt of the formula $$R_xNH_{(4-x)}^{30},[F_3C(CF_2)_yS(O)_2]_2N^-$$

where x is 1 to 3, R is independently $C_3H_7$, $C_4H_9$, $C_5H_{11}$, $C_6H_{13}$, $C_8H_{17}$, branched chain alkyl, cycloalkyl, alkyl substituted cycloalkyl, cycloalkyl substituted alkyl, or when x is greater than 1, two R groups comprise a cyclic structure including the nitrogen atom and 4 to 12 carbon atoms, and y is independently 0 to 11; and supplying said ammonium salt to the contact between two surfaces.

7. The method of claim 6, wherein said first surface and said second surface are independently a metal surface or a ceramic surface.

8. The method of claim 7, wherein said metal surface is an aluminum alloy or a steel alloy.

9. The method of claim 6, further comprising the steps of:

providing a mineral or hydrocarbon oil; and supplying said oil to the contact between said surfaces.

* * * * *